US009841775B2

(12) United States Patent
Bingel

(10) Patent No.: US 9,841,775 B2
(45) Date of Patent: Dec. 12, 2017

(54) SYSTEMS AND METHODS FOR ULTRA-PRECISION REGULATED VOLTAGE

(71) Applicant: Honeywell International Inc., Morristown, NJ (US)

(72) Inventor: Thomas J. Bingel, Indian Rocks Beach, FL (US)

(73) Assignee: Honeywell International Inc., Morris Plains, NJ (US)

( * ) Notice: Subject to any disclaimer, the term of this patent is extended or adjusted under 35 U.S.C. 154(b) by 394 days.

(21) Appl. No.: 14/566,997

(22) Filed: Dec. 11, 2014

(65) Prior Publication Data

US 2016/0170423 A1 Jun. 16, 2016

(51) Int. Cl.

| | |
|---|---|
| ***G05F 1/56*** | (2006.01) |
| ***G05F 1/10*** | (2006.01) |
| *G05F 1/46* | (2006.01) |
| *G05F 3/08* | (2006.01) |

(52) U.S. Cl.

CPC ..... *G05F 1/56* (2013.01); *G05F 1/10* (2013.01); *G05F 1/46* (2013.01); *G05F 3/08* (2013.01)

(58) Field of Classification Search

CPC ... G05F 1/10; G05F 1/46; G05F 1/461; G05F 1/465; G05F 1/562; G05F 1/563; G05F 1/614; G05F 1/618; G05F 1/56; G05F 1/66; G05F 3/02; G05F 3/08; G05F 3/30; G05F 5/00

See application file for complete search history.

(56) References Cited

U.S. PATENT DOCUMENTS

| | | | | |
|---|---|---|---|---|
| 5,121,049 | A | 6/1992 | Bass | |
| 5,801,584 | A | 9/1998 | Mori | |
| 6,424,225 | B1 * | 7/2002 | Choi | H03F 1/302 323/312 |
| 6,608,472 | B1 | 8/2003 | Kutz et al. | |
| 7,215,041 | B2 | 5/2007 | Huber et al. | |
| 7,619,402 | B1 * | 11/2009 | Kwong | G05F 1/575 323/297 |
| 9,013,231 | B1 * | 4/2015 | Manea | G05F 3/08 327/539 |
| 2004/0235437 | A1 * | 11/2004 | Gels | H03G 3/3047 455/127.1 |
| 2005/0206362 | A1 * | 9/2005 | Chen | G05F 3/30 323/313 |
| 2005/0264347 | A1 * | 12/2005 | Gyohten | G05F 1/465 327/540 |
| 2006/0006858 | A1 * | 1/2006 | Chiu | G05F 3/262 323/313 |

(Continued)

*Primary Examiner* — Gustavo Rosario Benitez
(74) *Attorney, Agent, or Firm* — Fogg & Powers LLC

(57) ABSTRACT

Systems and methods for ultra-precision regulated voltage are provided. In one embodiment, a voltage regulated power supply device comprises: a precision reference voltage generator comprising a current regulator network supplying current into a voltage reference node, and a voltage regulator network applying a voltage potential to the voltage reference node, wherein at least one of the current regulator network or the voltage regulator network comprise a random variance statistical mitigation architecture; and a power amplifier coupled to voltage reference node, where the voltage reference node provides a constant voltage reference to the power amplifier.

20 Claims, 6 Drawing Sheets

(56) References Cited

U.S. PATENT DOCUMENTS

| | | | | |
|---|---|---|---|---|
| 2010/0027180 | A1* | 2/2010 | Bingel | H02H 3/08 361/93.9 |
| 2012/0126892 | A1* | 5/2012 | Rabary | G05F 3/08 330/127 |
| 2015/0048883 | A1* | 2/2015 | Vinayak | H02M 3/06 330/127 |

* cited by examiner

SYSTEMS AND METHODS FOR ULTRA-PRECISION REGULATED VOLTAGE

BACKGROUND

Linear voltage regulators are devices that provide power to electronic loads at a consistent voltage regardless of the current draw from the connected loads. Linear voltage regulators capable of delivering current while maintaining the output voltage within 2% to 4% accuracy are available. However, in emerging technologies, such as ultra-precision sensors, the accuracy of the sensors are often limited by the ability to maintain precise and accurate excitation voltages to the sensors. As such, there is a need in the art for ever more accurate general-purpose voltage regulators and excitation-voltage regulators.

For the reasons stated above and for other reasons stated below which will become apparent to those skilled in the art upon reading and understanding the specification, there is a need in the art for alternate systems and methods for providing ultra-precision regulated voltage.

SUMMARY

The Embodiments of the present invention provide methods and systems for providing ultra-precision regulated voltage and will be understood by reading and studying the following specification.

Systems and methods for ultra-precision regulated voltage are provided. In one embodiment, a voltage regulated power supply device comprises: a precision reference voltage generator comprising a current regulator network supplying current into a voltage reference node, and a voltage regulator network applying a voltage potential to the voltage reference node, wherein at least one of the current regulator network or the voltage regulator network comprise a random variance statistical mitigation architecture; and a power amplifier coupled to voltage reference node, where the voltage reference node provides a constant voltage reference to the power amplifier.

DRAWINGS

Embodiments of the present invention can be more easily understood and further advantages and uses thereof more readily apparent, when considered in view of the description of the preferred embodiments and the following figures in which.

In accordance with common practice, the various described features are not drawn to scale but are drawn to emphasize features relevant to the present invention. Reference characters denote like elements throughout figures and text.

DETAILED DESCRIPTION

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

Embodiments of the present disclosure provide system and methods for ultra-precision regulated voltage power supplies by combining multiple precision voltage and current regulators with a precision power amplifier. In one embodiment, as described in greater detail below, a precision reference voltage generator is provided by coupling a current regulator network with a voltage regulator network to produce a reference voltage having low random variance. It should be appreciated that noise variances in electronic system comprise a random component and a systemic component. Whereas systemic variances result from the overall design of a circuit, random variances are predominantly the result in varying performance characteristic of individual electronic components within the circuits that make up a system. For a network formed with a number, X, of similar devices having random error distributions, the standard deviation of the network as a whole can be decreased as a function of the multiplicative factor $1/\sqrt{X}$. The arrangement of discrete elements within a circuit, such that random variances from one discrete element at least partially counteract random variance of another similar element, is referred to herein as a network that comprises a "random variance statistical mitigation architecture". More specifically, within a random variance statistical mitigation architecture, a function typically performed by a single component (such as a current regulator or voltage regulator) is distributed across X similar discrete elements that each perform that function, but at a reduced-scaled (defining the term "similar discrete elements" as used herein). The random variance statistical mitigation architecture then sums the results of the X similar discrete elements. The random variance of each of the similar discrete elements within the network having the random variance statistical mitigation architecture are essentially averaged out as further described in this disclosure to minimize the effect of individual component random variances on the variance of the function being performed as a whole.

Figure 1:
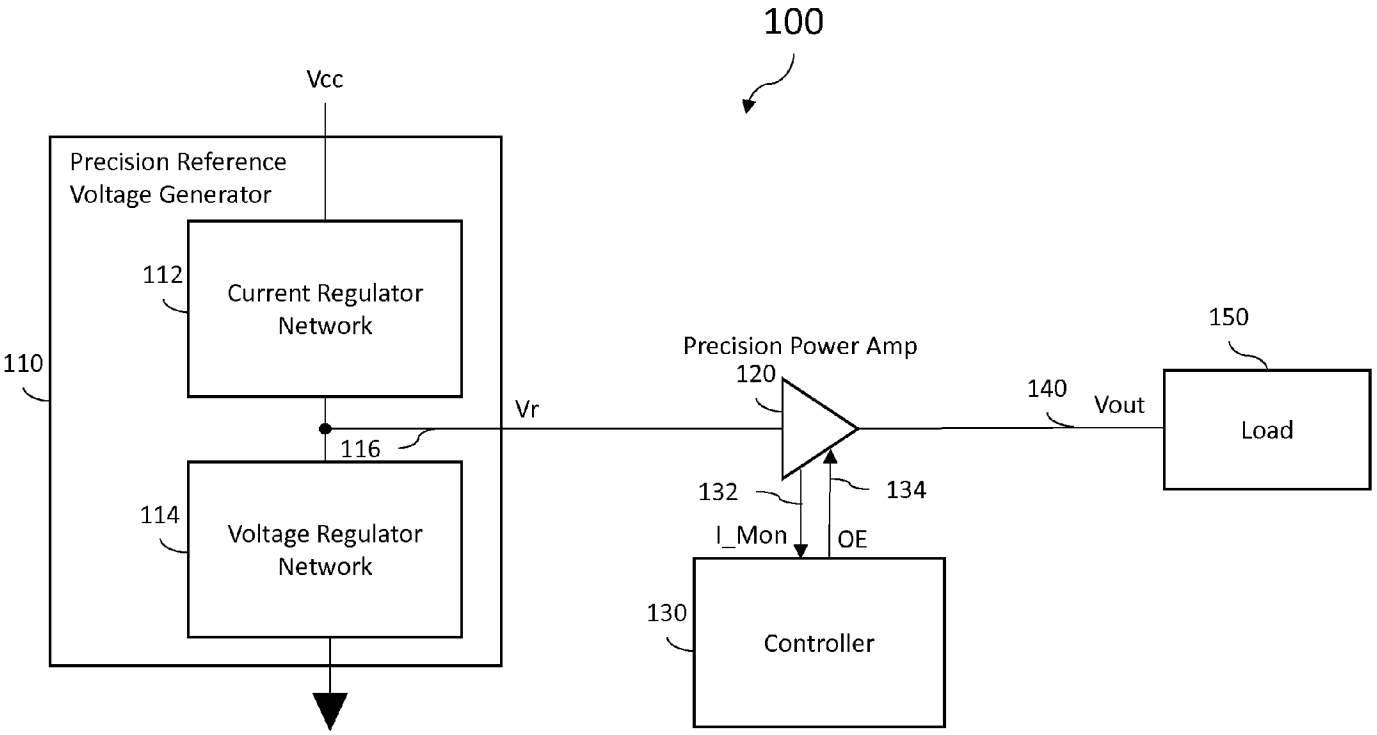
FIG. 1 is a block diagram of a voltage regulated power supply device of one embodiment of the present disclosure.

FIG. 1 is a block diagram illustrating a voltage regulated power supply device 100 of one embodiment of the present disclosure. As shown in FIG. 1, device 100 comprises a precision reference voltage generator 110 coupled between an unregulated system voltage Vcc and system ground. The Precision Reference Voltage Generator 110 includes a Current Regulator Network 112 coupled to a Voltage Regulator Network 114 at a common node 116. Current Regulator Network 112 supplies a flow of near constant DC current into node 116 while Voltage Regulator Network 114 holds node 116 near a specified voltage potential with respect to the system ground. The result is a low variance reference voltage (Vr) available from node 116. With embodiments of the present disclosure, either the Current Regulator Network 112 or the Voltage Regulator Network 114, or both, comprises a random variance statistical mitigation architecture. The low variance reference voltage Vr, then drives precision power amplifier 120 to produce an ultra-precision output voltage (Vout) 140 capable of supplying a high current output to a load 150. As FIG. 1 indicates, precision power amplifier 120 may be configured with a current monitoring signal output (I_Mon) 132 and an output enable input (OE) 134. I_Mon 132 and OE 134 are both coupled to a controller 130 that monitors the current output from power amplifier 120 (using I_Mon 132) and shuts down the amplifier 120 (using OE 134) when the current draw exceeds predetermine thresholds.

Figure 2:
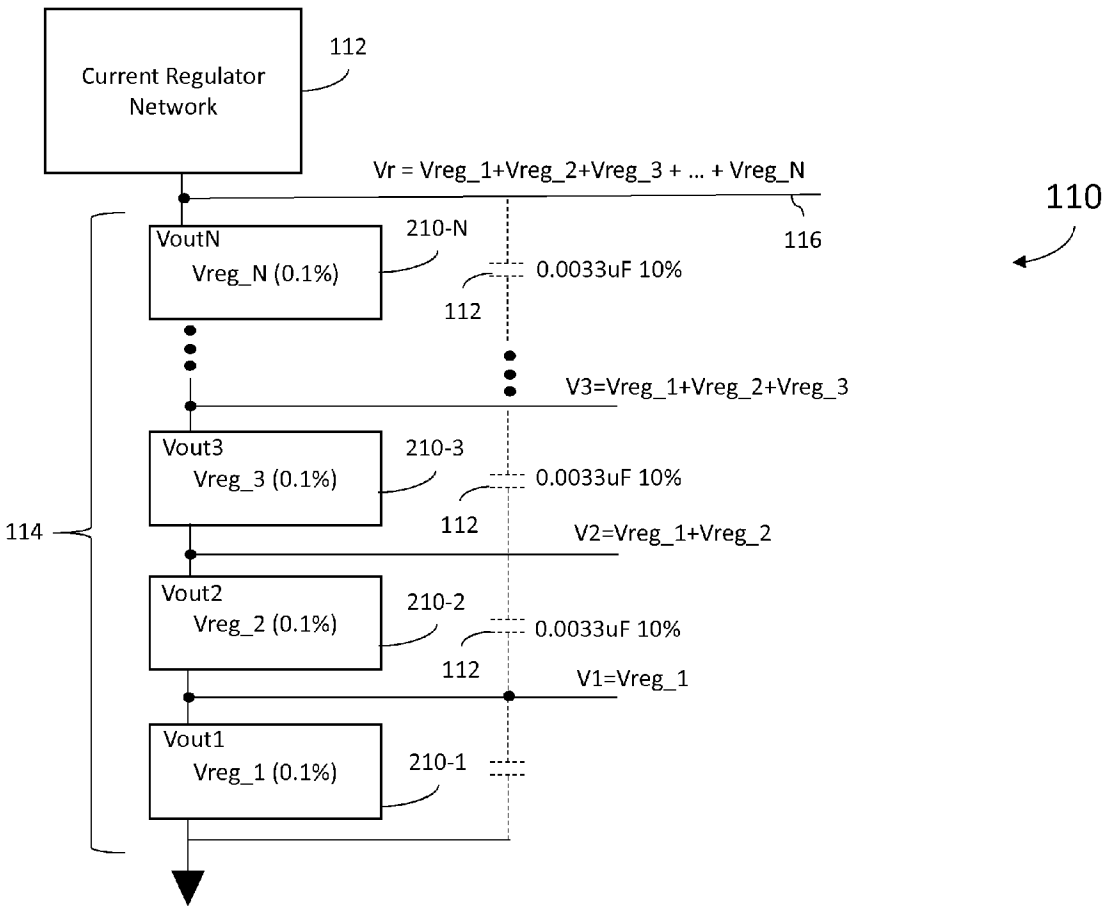
FIG. 2 is a block diagram of a voltage reference network comprising a random variance statistical mitigation architecture of one embodiment of the present disclosure.

FIG. 2 provides an example implementation of a Voltage Regulator Network 114 for the precision reference voltage generator 110 for one embodiment of the present disclosure. In this example, a random variance statistical mitigation architecture includes a plurality of "N" voltage regulator devices (shown at 210-1 to 210-N) coupled together in series. These voltage regulator devices are often also referred to as "shunt voltage regulators" or "bandgap voltage regulators." Voltage regulator device 210-1 is coupled to system ground and produces a fixed reverse breakdown voltage (V1) at its output terminal Vout1. Voltage regulator device 210-2 is coupled to the output terminal Vout1 of device 210-1 and produces a fixed reverse breakdown voltage (V2) at its output terminal Vout2. Voltage regulator device 210-3 is coupled to the output terminal Vout2 of device 210-2 and produces a fixed reverse breakdown voltage (V3) at its output terminal Vout3. The network continues to voltage regulator device 210-N, which is coupled to the output terminal of device 210-N−1 and produces a fixed reverse breakdown voltage (Vr) at its output terminal, VoutN, which is coupled to node 116. Clearly, by extension of Kirchhoff's circuits law, $$Vr = V\text{reg_1} + V\text{reg_2} + V\text{reg_3} + \ldots + V\text{reg_}N$$

Considering the Central Limit Theorem, and that devices 210-1 to 210-N are similar discrete elements having random error distributions, the standard deviation of Vr decreases by the multiplicative factor, $1/\sqrt{N}$ as compared to the case of using single component voltage regulator having Vreg=Vr directly. For example, in one embodiment, to produce a nominal reference voltage of Vr=10.0 V, each of the 210-1 to 210-N are 2.50 volt regulator devices (such as a LM4050-2.5 V voltage regulator, for example) having a 0.1% output voltage tolerance. Where N=4, then Vr=10.0 V and the standard deviation in the random variance of Vr is decreased, by a factor of $1/\sqrt{4}$ (i.e. a tolerance 50% that of a single 0.1% output tolerance component, 0.05%). Although this example illustrated each of the voltage reference devices 210-1 to 210-N having the same fixed regulator voltage, this is not necessary for the devices to be considered "similar". For example, in another embodiment with N=3, devices 210-1 and 210-2 may be 2.50 volt regulators each having a 0.1% output voltage tolerance, and device 210-3 is a 5.00 volt regulator having a 0.1% output voltage tolerance. In this example embodiment, the resulting Vr=10.0 volt and the standard deviation in the random variance of Vr is decreased, by a multiplication factor of $1/\sqrt{3}$ (i.e. a tolerance 57.7% that of a single 0.1% output tolerance component, 0.0577%).

Figure 3A:
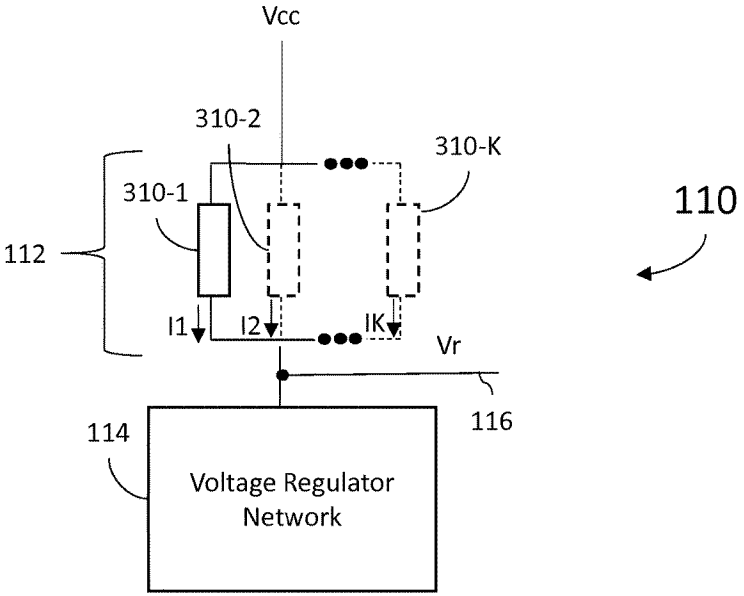
FIGS. 3A-3C are block diagrams illustrating current regulator networks configured to supply current to a voltage regulator network, wherein said current regulator network are comprised of a random variance statistical mitigation architecture of one embodiment of the present disclosure.
Figure 3C:
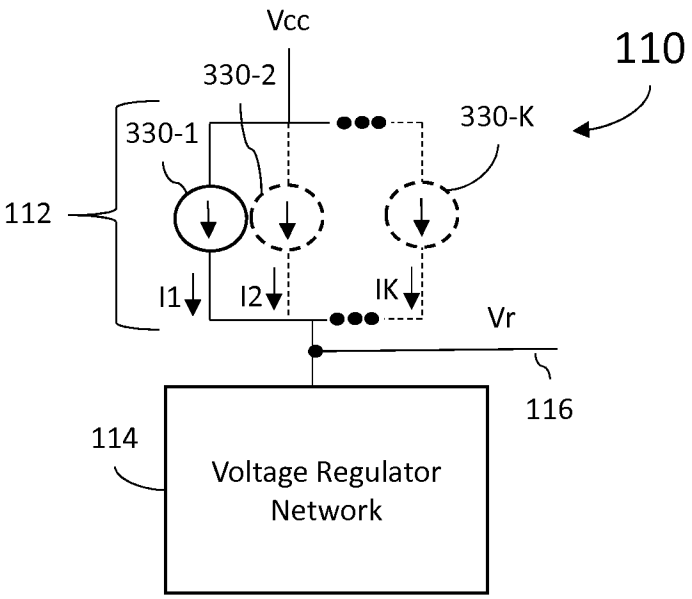
Figure 3B:
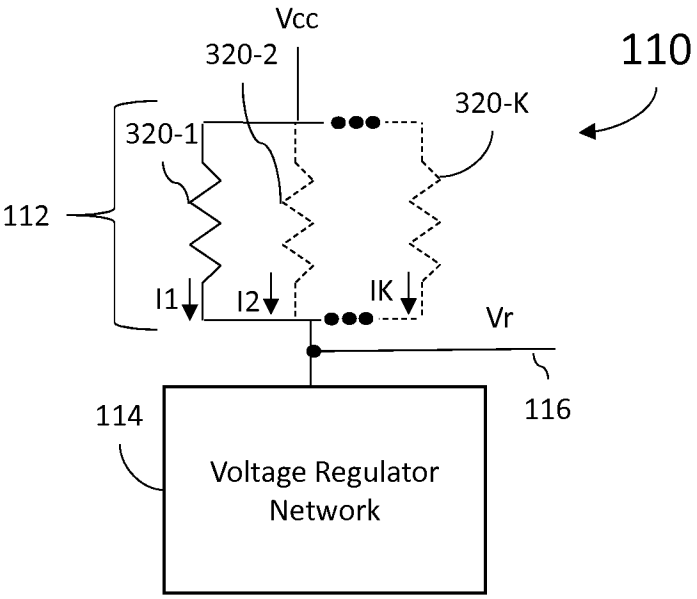

Next, referring to FIGS. 3A-3C, example implementations of a Current Regulator Network 112 for the precision reference voltage generator 110 for one embodiment of the present disclosure are disclosed. In the example illustrated in FIG. 3A, Current Regulator Network 112 is a random variance statistical mitigation architecture that comprises a plurality of "K" fixed current producing elements (shown at 310-1 to 310-K) coupled together in parallel between Vcc and node 116. The regulated current provided by the current network 112 into node 116 is Itotal=I1+I2+ . . . IK. For similar fixed current producing elements having random error distributions, the standard deviation of Itotal decreases by the multiplicative factor, $1/\sqrt{K}$, further reducing the variance of the dependent term Vr. As discussed above, similar devices are those performing scaled versions of the same function, and may have approximately equal output tolerances. Therefore it is not always necessary that each of the fixed current producing elements 310-1 to 310-K output the same regulated current value. Further, different embodiments may utilize various different means for implementing the regulated current producing elements 310-1 to 310-K. For example, FIG. 3B illustrates that the Current Regulator Network 112 may comprise fixed current producing elements using resistors (as shown at 320-1 to 320-K) or as shown in FIG. 3C, using solid state constant current source elements (as shown at 330-1 to 330-K). For each case, the standard deviation of Itotal into node 116 decreases by the multiplicative factor $1/\sqrt{K}$.

Returning to FIG. 1, in one implementation, the Current Regulator Network 112 has a random variance statistical mitigation architecture comprising a parallel network of at least two regulated current producing elements (i.e., K≥2) while the Voltage Regulator Network 114 has a random variance statistical mitigation architecture comprising a series network of at least two voltage regulator devices (i.e., N≥2). In this configuration, random variance in the reference voltage Vr is countered directly by network 114 with the multiplicative factor $1/\sqrt{N}$. The Current Regulator Network 112 provides improvement in producing reference voltage Vr at node 116 since the Voltage Regulator Network 114 is generally specified and optimized at one current value, for example, 100 uA. Current into the Voltage Regulator Network 114 at a value higher or lower than the specified and optimized value, for example, 100 uA, will result in decreased precision voltage produced by the Voltage Regulator Network 114. Hence, Current Regulator Network 112 variance mitigation minimizes the current variation applied to Voltage Regulator Network 114, thereby enabling Voltage Regulator Network precision voltage generation at node 116, Vr.

In other embodiments, the Voltage Regulator Network 114 has a random variance statistical mitigation architecture with at least two voltage regulator devices (i.e., N≥2) while the Current Regulator Network 112 comprises a single fixed current producing element, so that the random variance in the reference voltage Vr is countered as a function of $1/\sqrt{N}$. Alternatively, the Current Regulator Network 112 may have a random variance statistical mitigation architecture with at least two fixed current producing elements (i.e., K≥2) while the Voltage Regulator Network 114 comprises a single fixed current producing element, so that the variance in the reference voltage Vr is reduced. In any of these potential alternate embodiments, the number K of fixed current producing elements and the number N of voltage reference devices can be selected by the circuit designer to obtain the degree of variance mitigation desired for a given application. For example, where load 150 comprises a sensor, a whetstone bridge, or other device whose accuracy is directly affected by the excitation voltage supplied to the device, N and K may be selected to provide an excitation voltage, Vout, sufficiently stable to obtain the desired Vout voltage precision and variance.

As shown in FIG. 1, the resulting high precision reference voltage Vr drives the Precision Power Amplifier 120. Precision Power Amplifier 120 has high input resistance such that it consumes no or negligible input current from node 116. In some embodiments, power amplifier 120 comprises a unity gain amplifier. A power amplifier 120 having a gain other than a gain of 1 may be utilized, but the discrete components used to set such non-unity gains will introduce additional variances affecting the output tolerance of device 100. That is, configuring power amplifier 120 to be a unit gain amplifier eliminates the need for gain setting elements in the feedback network of amplifier 120, thus eliminating the introduction of random variance errors in the feedback network from such elements.

Figure 4:
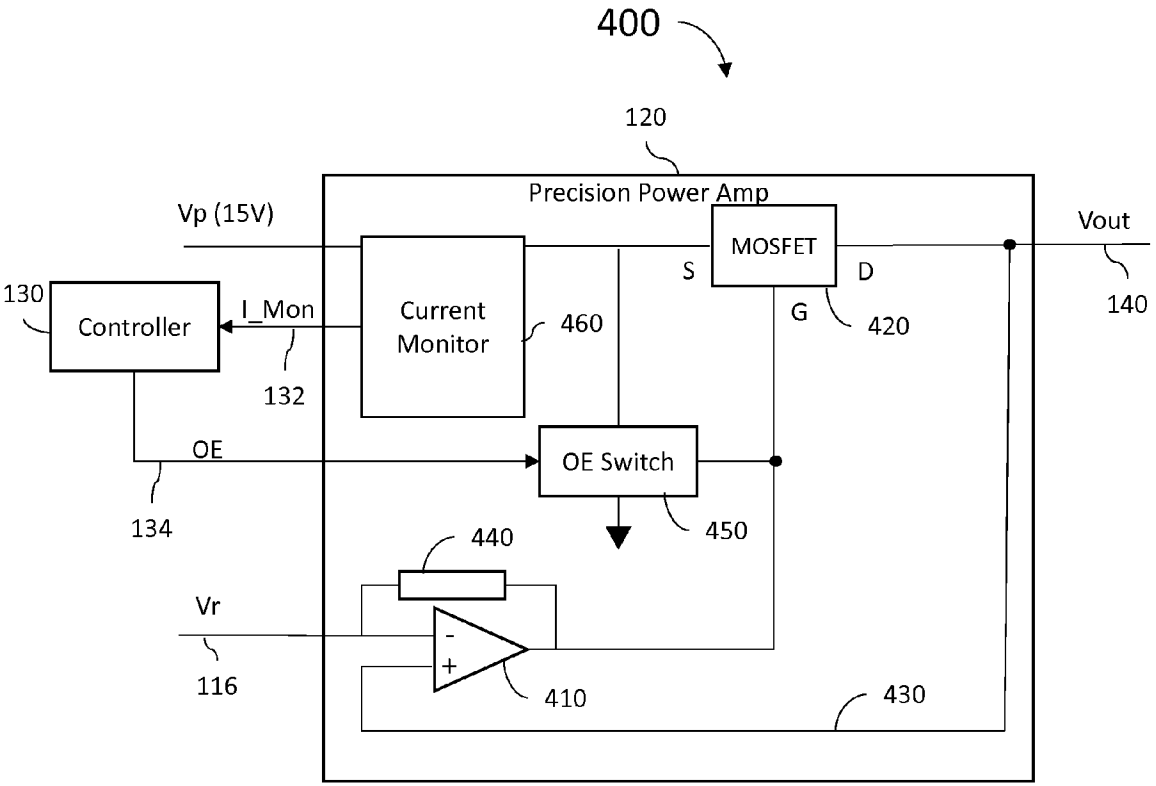
FIG. 4 is a block diagram illustrating a precision power amplifier for a voltage regulated power supply device of one embodiment of the present disclosure.

FIG. 4 is a block diagram illustrating at 400 one example embodiment of a Precision Power Amplifier 120. In this embodiment, power amplifier 120 comprises an operational amplifier (op amp) 410 that controls the voltage at the Gate terminal (G) of a MOSFET 420. The high precision reference voltage Vr drives the inverting input of op amp 410 while the non-inverting input is driven by a unit gain feedback network 430 coupled to the Drain terminal (D) of MOSFET 420. The Source terminal (S) of MOSFET 420 is connected to the unregulated station power supply voltage (Vp). In operation, MOSFET 420 functions as the output stage of amplifier 120, producing a stable voltage Vout at the current levels demanded by load 150, supplied by device 100. Current flow from the Source terminal (S) to Drain terminal (D) is supplied to meet that demand load at the voltage level established by op amp 410's control of Gate terminal (G). In this configuration, op amp 410 operates as an error amplifier. That is, the high precision reference voltage Vr provides a precision voltage reference. Feedback network 430 senses voltage variations in Vout, which may be caused by noise or variations in the unregulated station power supply voltage (Vp), changes in ambient temperature, or from other factors. Base on deviations between the precision reference voltage Vr and the feedback signal from feedback network 430, op amp 410 controls MOSFET 420 gate terminal (G) to ensure that MOSFET 420 is providing output Vout at rated voltage. In one embodiment, a tuning network 440 may be coupled between the output and non-inverting input of op amp 410 in order to optimally tune the transient response of power amplifier 120 and provide stability.

In one embodiment, Precision Power Amplifier 120 also comprises a current monitor circuit 460 coupled to the source terminal (S) input of MOSFET 420. In one implementation, current monitor circuit 460 includes a current sense resistor that develops a voltage that varies as a function of the current flowing into the source terminal (S) of MOSFET 420. That voltage provides the current monitoring signal I_Mon 132. As mentioned above, controller 130 monitors I_Mon 132 and toggles OE 134 to shut down Precision Power Amplifier 120 when the current draw exceeds predetermine thresholds. Controller 130 may be implemented using a field programmable gate array (FPGA) or other state machine. As such, controller 130 may include an analog-to-digital converter to convert the analog voltage signal I_Mon into a digital input. Precision Power Amplifier 120 further comprises an operate enable (OE) switch 450 coupled to the gate terminal (G) of MOSFET 420. In one embodiment, the output OE 134 from controller 130 is used to operate OE switch 450. More specifically, when OE 134 is toggled to a state to disable power amplifier 120, OE switch 450 places a bias voltage onto gate (G) of MOSFET 420 shutting down current flow between the Source and Drain of MOSFET 420. In one embodiment, when an overcurrent condition triggers disabling of amplifier 120, controller 130 re-enables the amplifier after a period of time (for example 1 second) to determine if the condition causing the overcurrent condition is still present. If the overcurrent condition is still present, controller 130 will then re-disable amplifier 120 within a few milliseconds. In one embodiment, controller 130 may perform this cycle multiple times until the condition causing the overcurrent clears. In other embodiments, controller 130 may perform this cycle a predetermined number of time before initiating a lockout that disables amplifier 120 until a reset is received.

Figure 5:
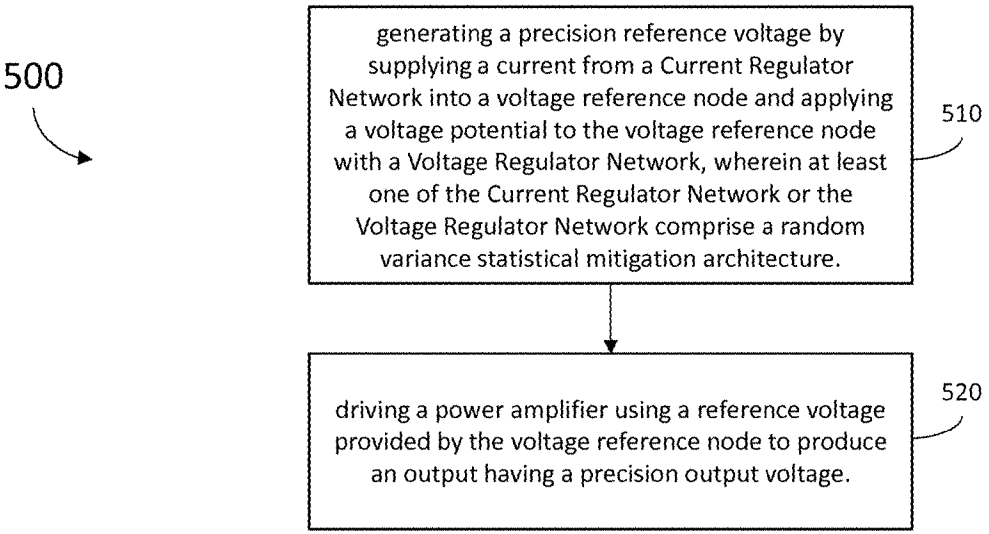
FIG. 5 is a flow chart illustrating a method of one embodiment of the present disclosure.

FIG. 5 is a flow chart illustrating a method 500 for providing voltage regulated power. In some embodiments, the method, or parts thereof, may be implemented using any of the various embodiments and implementations described with respect to the voltage regulated power supply device 100 described above. The method begins at 510 with generating a precision reference voltage by supplying a current from a Current Regulator Network into a voltage reference node and applying a voltage potential to the voltage reference node with a Voltage Regulator Network, wherein at least one of the Current Regulator Network or the Voltage Regulator Network comprise a random variance statistical mitigation architecture.

As described above, using a random variance statistical mitigation architecture, a function typically performed by a single component (such as a current source or voltage source) is distributed across X similar discrete elements that each perform that function, but at a reduced-scale. The random variance statistical mitigation architecture then sums the results of the X similar discrete elements. The random variance of each of the similar discrete elements within the network having the random variance statistical mitigation architecture are essentially averaged out as further described in this disclosure to minimize the effect of individual component random variances on the variance of the function being performed as a whole. For a network formed with a plurality, (i.e., $X \geq 2$) of similar devices having random error distributions, the standard deviation of the output of the network as a whole can be decreased as a function of the multiplicative factor $1/\sqrt{X}$.

In one embodiment, applying a voltage potential to the voltage reference node as described in block 510 further comprises summing voltages from a plurality of voltage regulators coupled in series, such as described above with respect to FIG. 2. In one such embodiment, the voltage network comprises a plurality of voltage regulators coupled in series, wherein the voltage potential at the voltage reference node is produced by the plurality of voltage regulators. In one embodiment, supplying a current from a current regulator network into the voltage reference node as described in block 510 further comprises summing currents from a plurality of fixed current regulators producing currents coupled together in parallel, such as described above with respect to FIGS. 3A-3C. In alternate embodiments, the plurality of fixed current producing elements coupled together in parallel may comprise either a plurality of resistors coupled in parallel or a plurality of solid state constant current sources coupled in parallel.

The method proceeds to 520 with driving a power amplifier using a reference voltage provided by the voltage reference node to produce an output having a precision output voltage. As mentioned above, the power amplifier may be a unity power amplifier or at least near unity gain. Configuring power amplifier to be a unit gain amplifier eliminates the need for gain setting elements in the feedback network of amplifier, thus eliminating the introduction of random variance errors in the feedback network from such elements. In one embodiment, driving the power amplifier in block 520 further comprises driving an operational amplifier (op-amp) having an output coupled to a gate of a metal-oxide-semiconductor field-effect transistor (MOSFET), wherein a first input of the op-amp is coupled to the voltage reference node. Feedback may be provided to the op-amp with a unity gain feedback network coupling an output of the MOSFET to a second input of the op-amp. The method 500 may further comprise monitoring a current flowing through the MOSFET with a controller and when the current flowing through the MOSFET exceed a predetermined threshold, biasing the MOSFET to shut off the current. The controller may be implemented using an FPGA or other programmable device coupled to the power amplifier such as described with respect to FIG. 4.

EXAMPLE EMBODIMENTS

Example 1 includes a voltage regulated power supply device, the device comprising: a precision reference voltage generator comprising a current regulator network supplying current into a voltage reference node, and a voltage regulator network applying a voltage potential to the voltage reference node, wherein at least one of the current regulator network or the voltage regulator network comprise a random variance statistical mitigation architecture; and a power amplifier coupled to voltage reference node, where the voltage reference node provides a constant voltage reference to the power amplifier.

Example 2 includes the device of example 1, wherein the random variance statistical mitigation architecture comprises a plurality of similar discrete elements; wherein a function performed by the random variance statistical mitigation architecture is distributed across a plurality of similar discrete elements that each perform the function at a reduced-scale; and wherein the random variance statistical mitigation architecture outputs to the voltage reference node a sum of output from the plurality of similar discrete elements.

Example 3 includes the device of any of examples 1-2, wherein the voltage regulator network comprises a plurality of voltage regulator devices coupled in series and defining a first random variance statistical mitigation architecture; and wherein the current regulator network comprises a plurality of fixed current producing elements coupled together in parallel and defining a second random variance statistical mitigation architecture.

Example 4 includes the device of any of examples 1-3, wherein the voltage network comprises a plurality of voltage regulators coupled in series, wherein the voltage potential at the voltage reference node is produced by the plurality of voltage regulators.

Example 5 includes the device of example 4, wherein the plurality of voltage regulators each have a same fixed voltage.

Example 6 includes the device of example 4, wherein a first of the plurality of voltage regulators comprises a fixed voltage different from a fixed voltage of a second of the plurality of voltage regulators.

Example 7 includes the device of any of examples 1-6, wherein the voltage regulator network comprises a plurality of fixed current producing elements coupled together in parallel.

Example 8 includes the device of example 7, wherein the plurality of fixed current producing elements comprises a plurality of resistors coupled together in parallel.

Example 9 includes the device of example 7, wherein the plurality of fixed current producing elements comprises a plurality of solid state constant current sources.

Example 10 includes the device of any of examples 1-9, wherein the power amplifier comprises: an operational amplifier (op-amp) having an output coupled to a gate of a metal-oxide-semiconductor field-effect transistor (MOSFET), wherein a first input of the op-amp is coupled to the voltage reference node; and a unity gain feedback network coupling an output of the MOSFET to a second input of the op-amp.

Example 11 includes the device of example 10, wherein the power amplifier further comprises: a current monitor circuit configured to monitor a current flowing through the MOSFET; and an operate enable switch configured to apply a bias voltage onto the gate of the MOSFET to shut off current flow from the MOSFET.

Example 12 includes the device of example 11, further comprising a controller, the controller coupled to the current monitor circuit and the operate enable switch of the power amplifier; wherein the controller outputs a signal to operate the operate enable switch to shut off current flow from the MOSFET when a signal from the current monitor circuit indicates that the current flowing through the MOSFET exceeds a predetermined threshold.

Example 13 includes a method for providing voltage regulated power, the method comprising: generating a precision reference voltage by supplying a current from a current regulator network into a voltage reference node and applying a voltage potential to the voltage reference node with a voltage regulator network, wherein at least one of the current regulator network or the voltage regulator network comprise a random variance statistical mitigation architecture; and driving a power amplifier using a reference voltage provided by the voltage reference node to produce an output having a precision output voltage.

Example 15 includes the method of example 13, wherein driving a power amplifier further comprises: driving an operational amplifier (op-amp) having an output coupled to a gate of a metal-oxide-semiconductor field-effect transistor (MOSFET), wherein a first input of the op-amp is coupled to the voltage reference node; and providing feedback to the op-amp with a unity gain feedback network coupling an output of the MOSFET to a second input of the op-amp.

Example 15 includes the method of any of examples 13-14, further comprising: monitoring a current flowing through the MOSFET with a controller; and when the current flowing through the MOSFET exceed a predetermined threshold, biasing the MOSFET to shut off the current.

Example 16 includes the method of any of examples 13-15, wherein the random variance statistical mitigation architecture comprises a plurality of similar discrete elements; wherein a function performed by the random variance statistical mitigation architecture is distributed across a plurality of similar discrete elements that each perform the function at a reduced-scale; and wherein the random variance statistical mitigation architecture outputs to the voltage reference node a sum of output from the plurality of similar discrete elements.

Example 17 includes the method of any of examples 13-16, wherein applying a voltage potential to the voltage reference node further comprises: summing voltages from a plurality of voltage regulators coupled in series.

Example 18 includes the method of any of example 17, wherein the voltage regulator network comprises a plurality of voltage regulators coupled in series, wherein the voltage potential at the voltage reference node is produced by the plurality of voltage regulators.

Example 19 includes the method of any of examples 13-18, wherein supplying a current from a current regulator network into the voltage reference node further comprises: summing currents from a plurality of fixed current producing elements coupled together in parallel.

Example 20 includes the method of example 19, wherein the plurality of fixed current producing elements coupled together in parallel comprises either: a plurality of resistors coupled in parallel; or a plurality of solid state constant current sources coupled in parallel.

In various alternative embodiments, system elements, processes, or examples described throughout this disclosure, such as but not limited to controller 130, may be implemented on one or more computer systems, field programmable gate array (FPGA), or similar device comprising a processor executing code to realize those elements, processes, or examples, said code stored on a non-transient data storage device. Therefore other embodiments of the present disclosure may include elements comprising program instructions resident on computer readable media which when implemented by such computer systems, enable them to implement the embodiments described herein. As used herein, the term "computer readable media" refers to tangible memory storage devices having non-transient physical forms. Such non-transient physical forms may include computer memory devices, such as but not limited to punch cards, magnetic disk or tape, any optical data storage system, flash read only memory (ROM), non-volatile ROM, programmable ROM (PROM), erasable-programmable ROM (E-PROM), random access memory (RAM), or any other form of permanent, semi-permanent, or temporary memory storage system or device having a physical, tangible form. Program instructions include, but are not limited to computer-executable instructions executed by computer system processors and hardware description languages such as Very High Speed Integrated Circuit (VHSIC) Hardware Description Language (VHDL).

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A voltage regulated power supply device, the device comprising:

a precision reference voltage generator comprising a current regulator network supplying current into a voltage reference node, and a voltage regulator network applying a voltage potential to the voltage reference node, wherein at least one of the current regulator network or the voltage regulator network comprise a random variance statistical mitigation architecture; and a power amplifier coupled to voltage reference node, where the voltage reference node provides a constant voltage reference to the power amplifier; and wherein the power amplifier comprises an operational amplifier (op-amp) having an output coupled to an input of a power transistor, wherein a first input of the op-amp is coupled to the voltage reference node;

wherein the random variance statistical mitigation architecture outputs to the voltage reference node a sum of outputs from a plurality of similar discrete elements.

2. The device of claim 1, wherein a function performed by the random variance statistical mitigation architecture is distributed across the plurality of similar discrete elements that each perform the function at a reduced-scale.

3. The device of claim 1, wherein the voltage regulator network comprises a plurality of voltage regulator devices coupled in series and defining a first random variance statistical mitigation architecture; and wherein the current regulator network comprises a plurality of fixed current producing elements coupled together in parallel and defining a second random variance statistical mitigation architecture.

4. The device of claim 1, wherein the voltage network comprises a plurality of voltage regulators coupled in series, wherein the voltage potential at the voltage reference node is produced by the plurality of voltage regulators.

5. The device of claim 4, wherein the plurality of voltage regulators each have a same fixed voltage.

6. The device of claim 4, wherein a first of the plurality of voltage regulators comprises a fixed voltage different from a fixed voltage of a second of the plurality of voltage regulators.

7. The device of claim 1, wherein the current regulator network comprises a plurality of fixed current producing elements coupled together in parallel.

8. The device of claim 7, wherein the current regulator network comprises a plurality of resistors coupled together in parallel.

9. The device of claim 7, wherein the plurality of fixed current producing elements comprises a plurality of solid state constant current sources.

10. The device of claim 1, wherein the power transistor further comprises a metal-oxide-semiconductor field-effect transistor (MOSFET);

wherein the power amplifier comprises:

the operational amplifier (op-amp) having an output coupled to a gate of the MOSFET; and a unity gain feedback network coupling an output of the MOSFET to a second input of the op-amp.

11. The device of claim 10, wherein the power amplifier further comprises:

a current monitor circuit configured to monitor a current flowing through the MOSFET; and an operate enable switch configured to apply a bias voltage onto the gate of the MOSFET to shut off current flow from the MOSFET.

12. The device of claim 11, further comprising a controller, the controller coupled to the current monitor circuit and the operate enable switch of the power amplifier;

wherein the controller outputs a signal to operate the operate enable switch to shut off current flow from the MOSFET when a signal from the current monitor circuit indicates that the current flowing through the MOSFET exceeds a predetermined threshold.

13. A method for providing voltage regulated power, the method comprising:

generating a precision reference voltage by supplying a current from a current regulator network into a voltage reference node and applying a voltage potential to the voltage reference node with a voltage regulator network, wherein at least one of the current regulator network or the voltage regulator network comprise a random variance statistical mitigation architecture; and driving a power amplifier using a reference voltage provided by the voltage reference node to produce a precision output voltage;

wherein driving the power amplifier further comprises:

driving an operational amplifier (op-amp) having an output coupled to an input of a power transistor, wherein a first input of the op-amp is coupled to the voltage reference node;

wherein the random variance statistical mitigation architecture outputs to the voltage reference node a sum of outputs from a plurality of similar discrete elements.

14. The method of claim 13, wherein the power transistor comprises a metal-oxide-semiconductor field-effect transistor (MOSFET), the operational amplifier (op-amp) having an output coupled to a gate of the MOSFET;

wherein driving the power amplifier further comprises:

providing feedback to the op-amp with a unity gain feedback network coupling an output of the MOSFET to a second input of the op-amp.

15. The method of claim 13, further comprising:

monitoring a current flowing through the MOSFET with a controller; and when the current flowing through the MOSFET exceed a predetermined threshold, biasing the MOSFET to shut off the current.

16. The method of claim 13, wherein a function performed by the random variance statistical mitigation architecture is distributed across a plurality of similar discrete elements that each perform the function at a reduced-scale; and wherein the random variance statistical mitigation architecture outputs to the voltage reference node a sum of outputs from the plurality of similar discrete elements.

17. The method of claim 13, wherein applying the voltage potential to the voltage reference node further comprises:

summing voltages from a plurality of voltage regulators coupled in series.

18. The method of claim 17, wherein the voltage regulator network comprises the plurality of voltage regulators coupled in series, wherein the voltage potential at the voltage reference node is produced by the plurality of voltage regulators.

19. The method of claim 13, wherein supplying a current from the current regulator network into the voltage reference node further comprises:

summing currents from a plurality of fixed current producing elements coupled together in parallel.

20. The method of claim 19, wherein the current regulator network comprises either:

a plurality of resistors coupled in parallel; or a plurality of solid state constant current sources coupled in parallel.

* * * * *